US008201542B2

(12) United States Patent
Huang et al.

(10) Patent No.: US 8,201,542 B2
(45) Date of Patent: Jun. 19, 2012

(54) SAFETY DEVICE FOR THE THROTTLE OPERATION

(75) Inventors: Hui-Hui Huang, Tainan Hsien (TW); Wen Ru Tseng, Tainan Hsien (TW)

(73) Assignee: Aeon Motor Co., Ltd., Tainan Hsien (TW)

( * ) Notice: Subject to any disclaimer, the term of this patent is extended or adjusted under 35 U.S.C. 154(b) by 575 days.

(21) Appl. No.: 12/461,561

(22) Filed: Aug. 17, 2009

(65) Prior Publication Data

US 2011/0036328 A1 Feb. 17, 2011

(51) Int. Cl.
*F02D 11/10* (2006.01)

(52) U.S. Cl. ..... 123/397; 123/399

(58) Field of Classification Search ..... 123/395, 123/396, 397, 399
See application file for complete search history.

(56) References Cited

U.S. PATENT DOCUMENTS

| | | | | |
|---|---|---|---|---|
| 5,429,090 | A * | 7/1995 | Kotchi et al. | 123/396 |
| 6,286,481 | B1 * | 9/2001 | Bos et al. | 123/399 |
| 6,375,151 | B1 * | 4/2002 | Vanderveen et al. | 251/129.12 |
| 7,207,313 | B2 * | 4/2007 | Torii | 123/396 |
| 7,987,834 | B2 * | 8/2011 | Itagaki | 123/397 |
| 2004/0173182 | A1 * | 9/2004 | Hedrick et al. | 123/396 |
| 2005/0087172 | A1 * | 4/2005 | Torii | 123/396 |

* cited by examiner

*Primary Examiner* — Erick Solis
(74) *Attorney, Agent, or Firm* — Bacon & Thomas, PLLC

(57) ABSTRACT

A safety device for the throttle operation includes a shaft, a linking plate having an end connected and moving with the shaft and another end provided with an projecting bent wing, a pulling plate having one end formed with a shaft hole for combining with the shaft and located at a side of the bent wing and another end resting on an end surface of the bent wing and connected with a throttle line. The bent wing moves the throttle line to move the pulling plate for an angle for opening the throttle. The safety device further includes a contact switch for contacting the linking plate so an engine control system may be electrified by the contact switch to reduce its speed to a slow condition even if the throttle line is stuck immovable and unable to return to its original position after pulling open the throttle, keeping safe a vehicle.

4 Claims, 6 Drawing Sheets

SAFETY DEVICE FOR THE THROTTLE OPERATION

BACKGROUND OF THE INVENTION

1. Field of the Invention

This invention relates to a safety device for the throttle operation, particularly to one capable to solve a grave problem that the throttle is stuck immovable and the engine is consequently keeping operation at a high speed, impossible to be controlled to reduce the speed of its operation.

2. Description of the Prior Art

As to the traditional mode of controlling a vehicle throttle, the throttle lever is pushed upward by means of an end of a spring, with the throttle lever having one end connected to a shaft; the shaft has one end connected to a linking plate that is connected to a throttle line at one end. Then the shaft can be moved by the throttle lever, with the linking plate and the throttle line shifting synchronously, so the throttle valve may be opened in various degrees and the engine operates to give out an output to drive a vehicle. If the throttle line is released, then it may at once recover the original position to decrease the operating speed of the engine to a slow condition. This kind of pressing down and releasing movement for controlling the throttle is not so ideal, because the throttle line can be frozen to get stuck in case of much moisture in a cold weather. Moreover, if the throttle line becomes old or something miscellaneous enters to tightening the throttle line immovable, it cannot work normally. Or the throttle valve in the throttle does not work well because of its old age or of inferior quality. All those defects can affect the normal function of the operation of the throttle which may cause irregular operation of the engine that may keep its high speed of operation without possibility of lowing down its speed. This conventional uncontrollability of a vehicle easily gives rise to a danger in driving.

SUMMARY OF THE INVENTION

This invention has been devised to offer a safety device for the throttle operation for the purpose to keep a vehicle safely from causing dangerous driving.

The characteristics of the safety device for the throttle operation are a linking plate, a pulling plate, a throttle line, a throttle lever, and a contract switch. The linking plate has one end connected to a shaft and another end formed with a bent wing. The pulling plate has one end formed with a shaft hole to connect with the shaft and located at a side of the bent wing and another end resting on the end surface of the bent wing, which moves the throttle line to pull the pulling plate to shift for an angle for opening the throttle. The contact switch has a contact point contacting the surface of the linking plate during the throttle lever not yet stepped down. When the contact point comes to contact the linking plate, the contact switch may electrify an engine control system, which functions to force the engine to reduce it speed to a slow condition, even if the throttle line is stuck immovable due to frozen moisture by cold temperature after opening the throttle. Moreover, even if an alternative ignition control system is used, the engine power can be reduced or completely be interrupted its output until the engine comes to a slow condition, preventing a vehicle from causing a wild operation of the engine.

BRIEF DESCRIPTION OF DRAWINGS

This invention will be better understood by referring to the accompanying drawings, wherein.

DETAILED DESCRIPTION OF THE INVENTION

Figure 1:
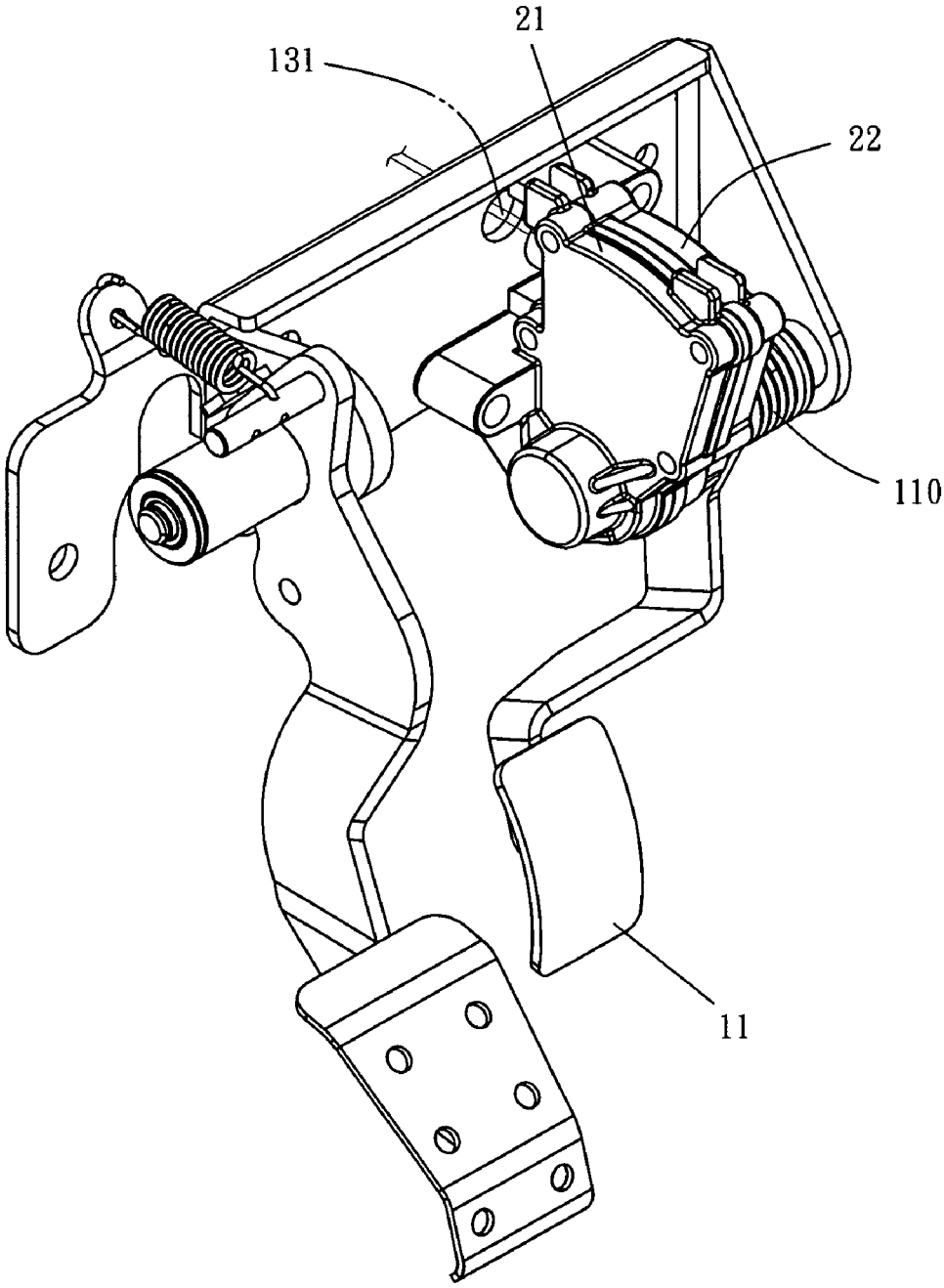
FIG. 1 is a perspective view of a safety device for the throttle operation in the present invention.
Figure 2:
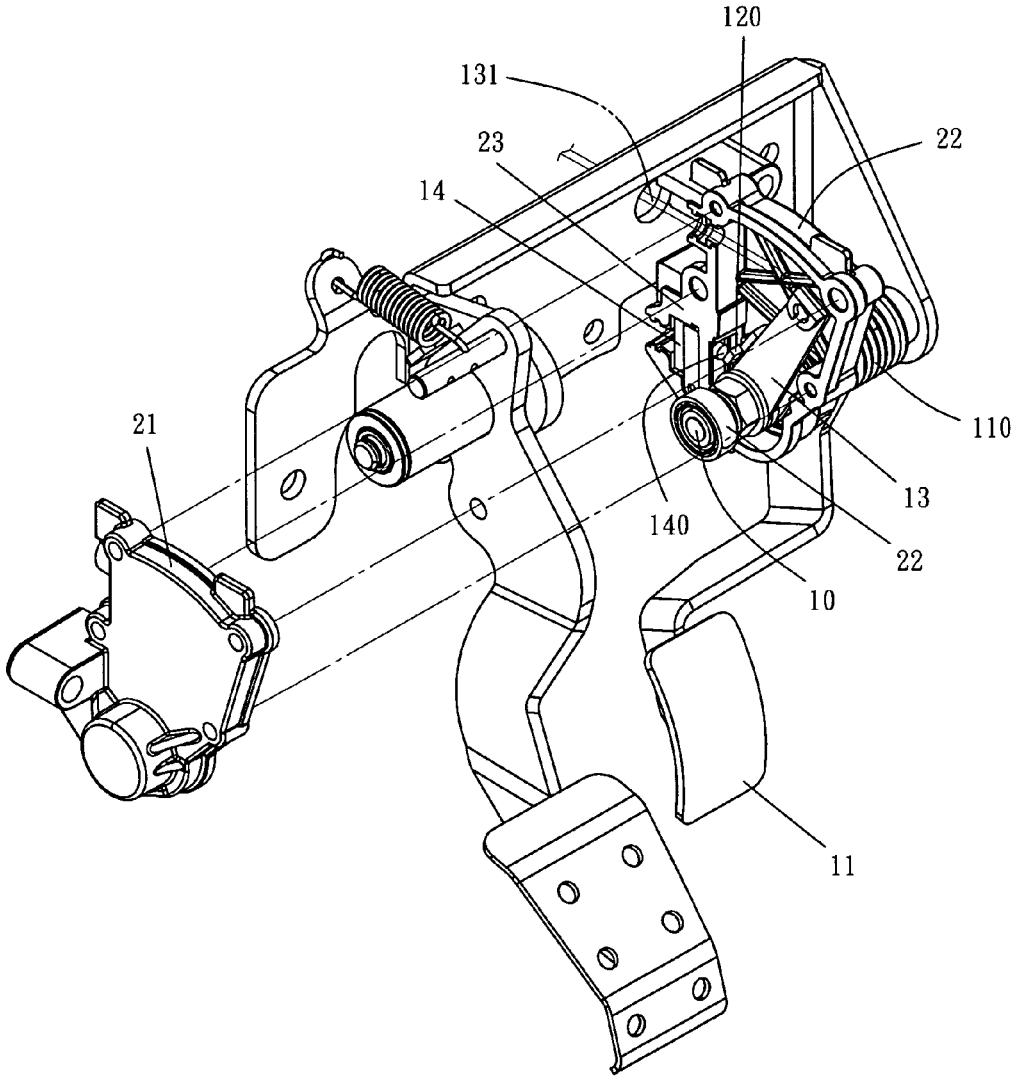
FIG. 2 is an exploded perspective view of some parts of the safety device for the throttle operation in the present invention.
Figure 3:
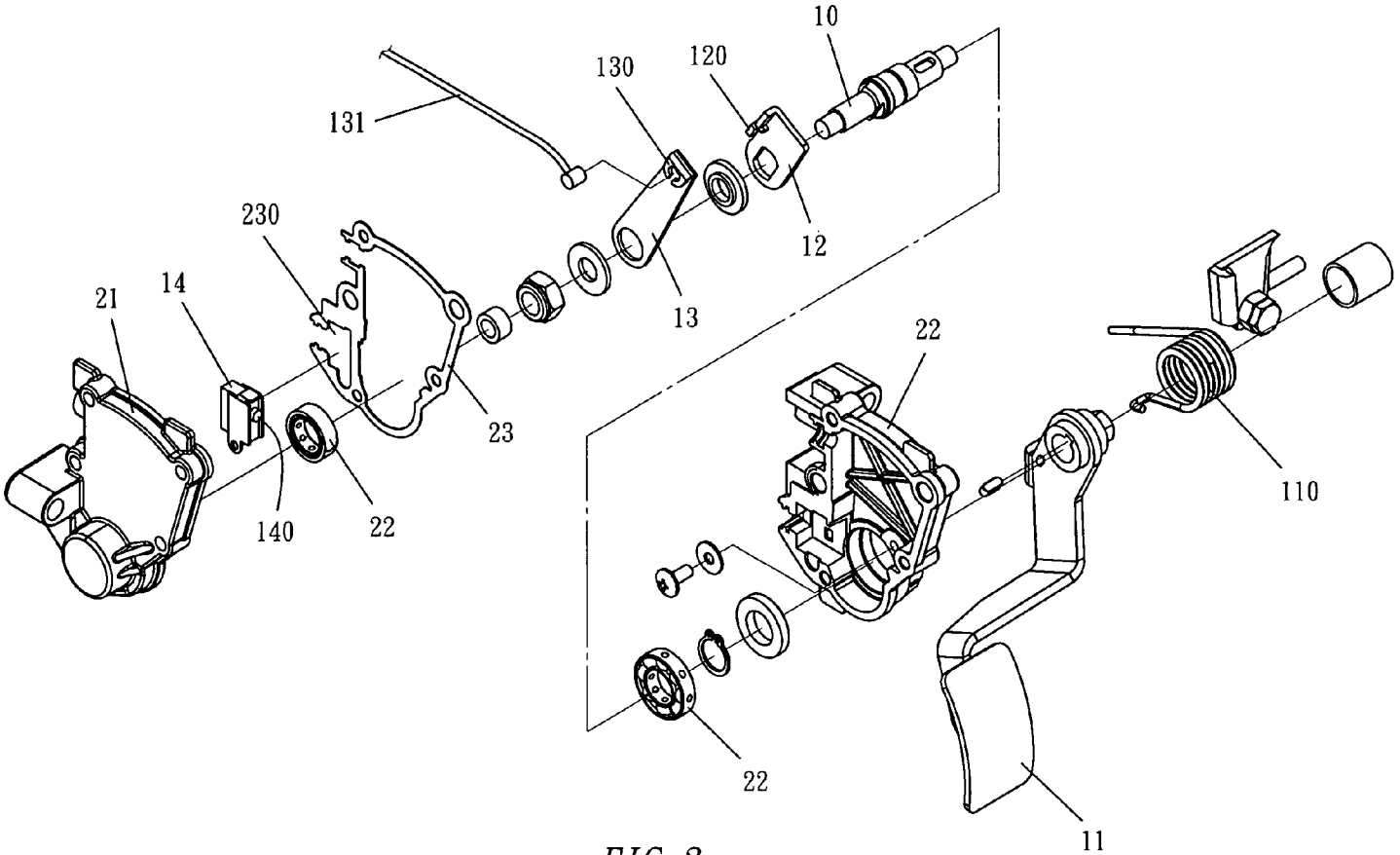
FIG. 3 is an exploded perspective view of the safety device for the throttle operation in the present invention.

A safety device for a throttle operation in the present invention, as shown in FIGS. 1, 2 and 3, includes a shaft 10, a throttle lever 11, a linking plate 12, a pulling plate 13, and a contact switch 14 as main components.

The shaft 10 passes through two shells 20, 21, supported by a bearing 22 at two ends respectively.

The throttle lever 11 is connected with a torque spring 110 at one end, being hung up by the torque spring 110, with another end combined with the shaft 10 by non-circular connection. So the throttle lever 11 and the shaft 10 move synchronously and diametrically, activating the shaft 10 rotates for an angle at that position when the throttle lever is stepped down.

The linking plate 12 is combined with the shaft 10 at one end by means of non-circular connection, activating the shaft 10 to rotate diametrically and synchronously, with another end formed with a bent wing 120 with a 90 degree bending.

The pulling plate 13 is positioned at a side of the bent wing 120 of the linking plate 12, having one end formed with a round hole for movably combined with the shaft 10, and the other end resting on a side surface of the bent wing 120 and having a pilling member 130 formed thereon to connect to a throttle line 131.

The contact switch 14 is fixed in a clamp hole 230 of a gasket 23, having a contact point 140 contacting the linking plate 12 when the throttle lever 11 is not yet stepped down. When the contact point 140 is moved to contact the linking plate 12, the contact switch 14 becomes electrically connected to the engine controller system. In the condition that the contact switch 14 is connected to the engine controller system, if the engine controller system finds out the engine is keeping operation at a high speed, and impossible to slow down, with the contract switch 14 being found at the position of the throttle shut down, the engine controller system will force the engine to slow down its operation. And even if the alternate ignition control system is used, the engine may be forced to cut down its output or may be completely interrupted in its output until the engine may recover the "slow" operating condition. Thus the wild operation of a vehicle can be prevented from happening.

Figure 4:
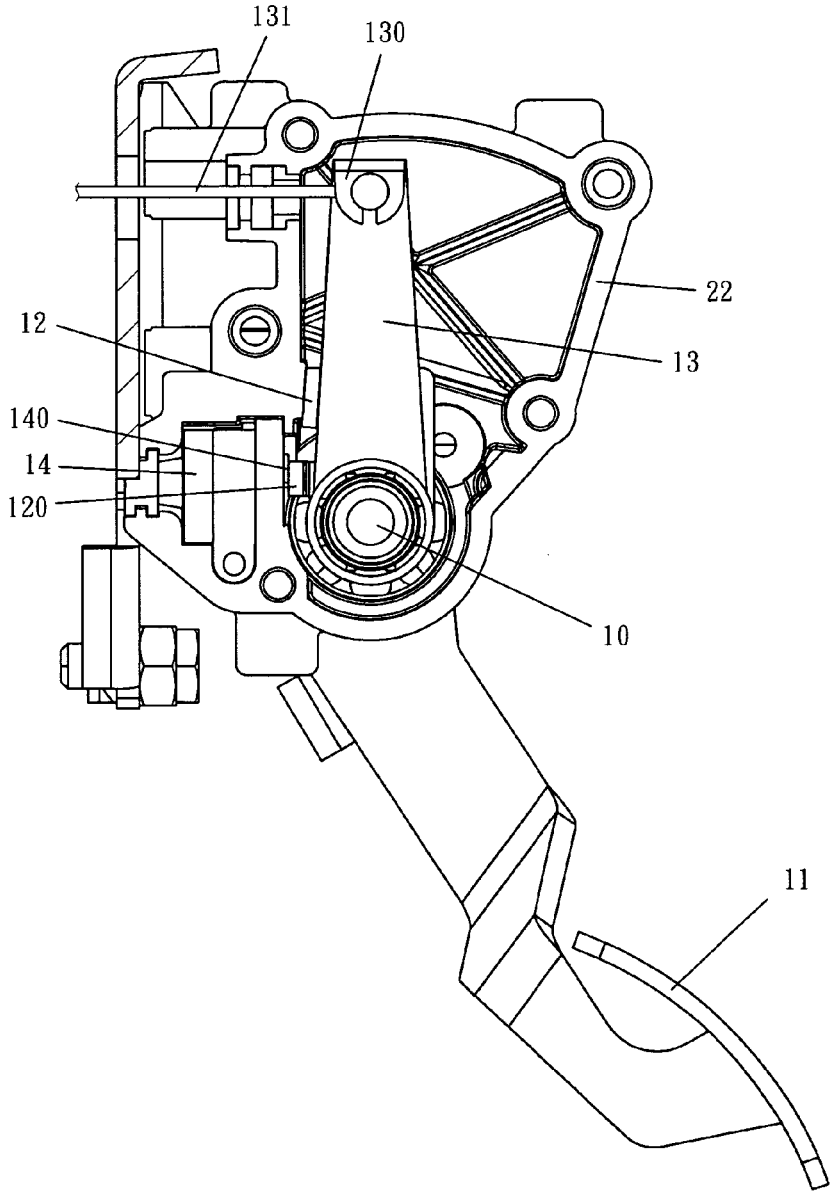
FIG. 4 is a side view of the safety device for the throttle operation in the present invention, showing it in an unused condition, with the throttle lever not yet stepped down.
Figure 5:
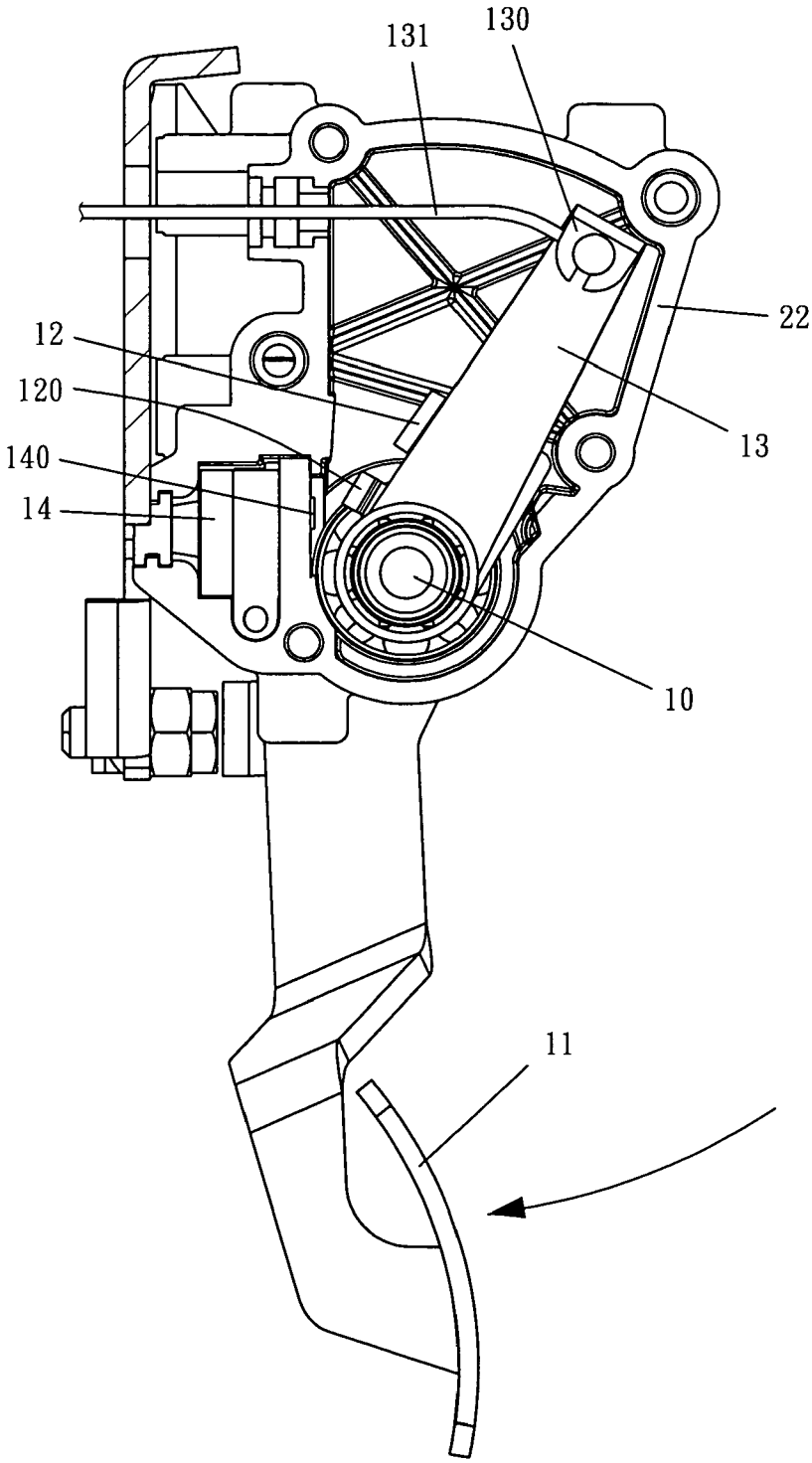
FIG. 5 is a side view of the safety device for the throttle operation in the present invention, showing it in a used condition with the throttle lever stepped down.

How to use this method is to be described as follows, referring to FIGS. 1, 4 and 5.

1. If the throttle lever is stepped down as shown in FIG. 5, the shaft 10 rotates for an angle at the same time, with the linking plate 12 also rotating for the same angle, so the bent wing 120 activates the pulling plate 13 to shift for a same distance. Then the throttle line 131 connected to the pulling member 130 of the pulling plate 13 is moved for a certain distance to open the throttle for a certain degree.

Figure 6:
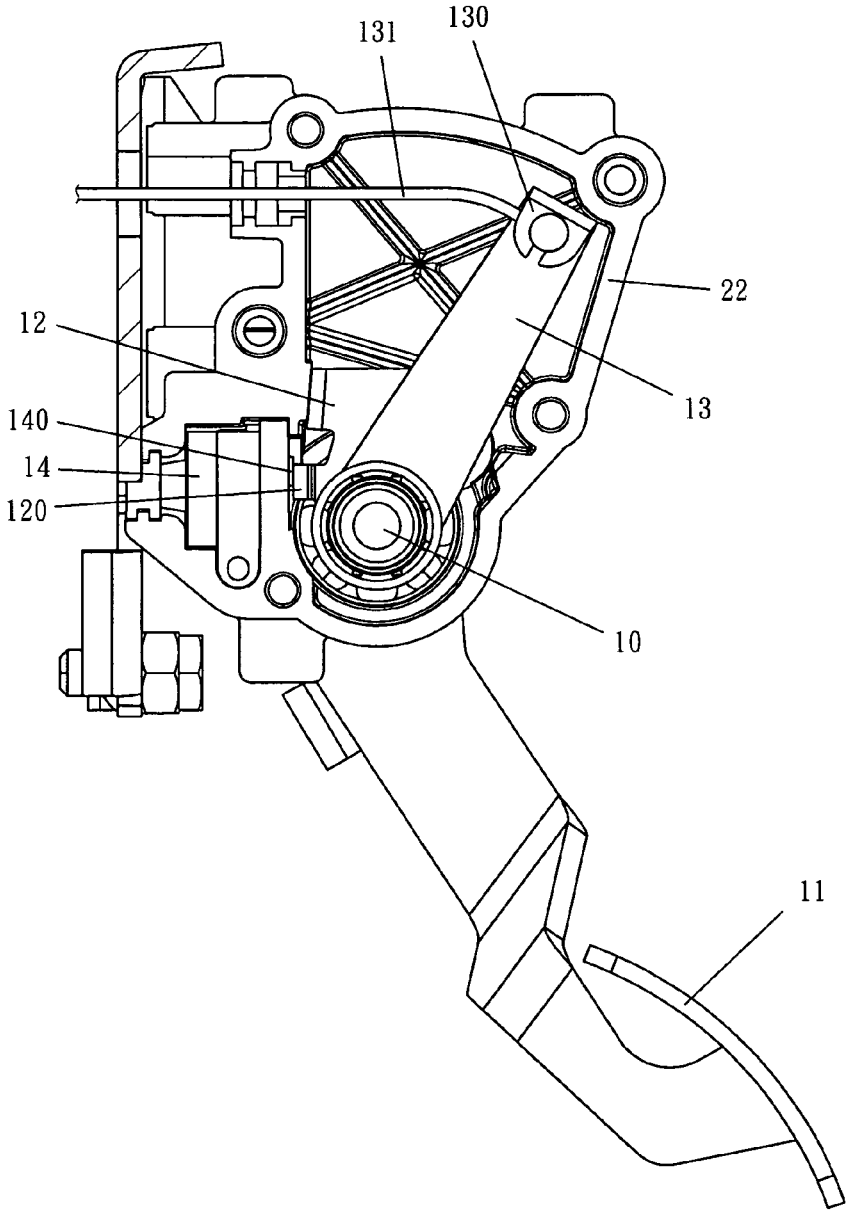
FIG. 6 is a side view of the safety device for the throttle operation, showing the throttle line not yet returned to its original position after the throttle lever stepped down.

2. If the throttle lever 11 is released as shown in FIG. 4, the torque spring 110 pushes back the throttle lever 11 by its elasticity, forcing the shaft 10 and the linking plate 12 to return to their original position, with the pulling plate 13 no longer pushed, pulled back by the elasticity of the throttle line 131. Thus the throttle is not closed, letting the vehicle reduces continually its speed and comes to a slow condition If the throttle line 131 is stuck immovable because of frozen moisture or any other factor after releasing the throttle lever 11, the throttle line 131 and the pulling plate 13 cannot return to their original position as shown in FIG. 6. In the meantime, the shaft 10 and the throttle lever 11 together are to be forced back to their original position by the torque spring 110 after releasing the throttle lever 11, so the linking plate 13 may return to its original position, contacting the contact point 140 of the contact switch 14 so as to start the switch 14 accordingly, and the switch 14 then electrifies the engine control system. Then the engine may reduce its operating speed to the slow condition. Even if the throttle is opened more and the throttle line is stuck immovable by frozen moisture due to very low temperature or any other factor, the contacting of the linking plate 13 with the contact point 140 of the contact switch 14 can start the contact switch 14 to activate the engine control system to force the engine to reduce its working speed to the slow condition, keeping safe driving of a vehicle.

The invention has the following advantages as can be seen from the above description.

1. Even though the throttle line is stuck immovable owing to frozen moisture by cold temperature or any other factor, with the engine impossible to slow down the speed, the vehicle can still be slowed down by releasing the throttle lever by the function of the safety device for the throttle operation in the invention.
2. It has a simple structure for assembling and disassembling.

While the preferred embodiment of the invention has been described above, it will be recognized and understood that various modifications may be made therein and the appended claims are intended to cover all such modifications that may fall within the spirit and scope of the invention.

What is claimed is:

1. A safety device for the throttle operation comprising:

A shaft supported by a bearing at two ends respectively;

A throttle lever combined with a torque spring at one end to be hung upward, said throttle lever having another end combined with said shaft and moving together with said shaft diametrically and synchronously, said throttle lever rotating for an angle when stepped down;

A linking plate having one end combined with said shaft and moving together with said shaft diametrically and synchronously, said linking plate having another end formed with a bent wing extending to one side;

A pulling plate located beside said bent wing of said linking plate and having one end movably connected to said shaft, said pulling plate having another end resting on a side surface of said bent wing of said linking plate; and A contact switch fixed at one side of said linking plate and having a contact point to contact with a surface of said linking plate during said throttle lever not stepped down, said linking plate contacting said contact point of said contact switch when the linking plate returns to its original position so that said contact switch may electrify an engine control system to function to force said engine to reduce its speed to a slow condition, protecting safely a vehicle from causing danger in driving.

2. The safety device for the throttle operation as claimed in claim 1, wherein said throttle lever and said shaft are combined together by means of a non-circular connection.

3. The safety device for the throttle operation as claimed in claim 1, wherein said linking plate is combined with said shaft by means of a non-circular connection.

4. The safety device for the throttle operation as claimed in claim 1, wherein said pulling plate is provided with a pulling member formed on an end to be connected to said throttle line.

* * * * *

UNITED STATES PATENT AND TRADEMARK OFFICE
Certificate

Patent No. 8,201,542 B2 Patented: June 19, 2012

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Hui-Hui Huang, Tainan Hsien (TW); Wen Ru Tseng, Tainan Hsien (TW); Paul Alan Krahn, Roseau, MN (US); and Eric Bjerketvedt, North Branch, MN (US).

Signed and Sealed this Twenty-fifth Day of November 2014.

STEPHEN K. CRONIN
*Supervisory Patent Examiner*
Art Unit 3747
Technology Center 3700